US006668726B2

(12) United States Patent
Lussier

(10) Patent No.: US 6,668,726 B2
(45) Date of Patent: Dec. 30, 2003

(54) SHAPED CHARGE LINER AND PROCESS

(75) Inventor: Michael Norman Lussier, Calgary (CA)

(73) Assignee: Innicor Subsurface Technologies Inc., Calgary (CA)

( * ) Notice: Subject to any disclaimer, the term of this patent is extended or adjusted under 35 U.S.C. 154(b) by 0 days.

(21) Appl. No.: 10/046,746

(22) Filed: Jan. 17, 2002

(65) Prior Publication Data

US 2003/0131749 A1 Jul. 17, 2003

(51) Int. Cl.[7] ..... F42B 1/02
(52) U.S. Cl. ..... 102/307; 102/476
(58) Field of Search ..... 102/307, 476

(56) References Cited

U.S. PATENT DOCUMENTS 2,757,611 A * 8/1956 Church et al. ..... 102/307
2,984,307 A * 5/1961 Barnes ..... 102/307
5,509,356 A * 4/1996 Renfro ..... 102/307
5,656,791 A * 8/1997 Reese et al. ..... 102/307
6,021,714 A * 2/2000 Grove et al. ..... 102/307
6,349,649 B1 * 2/2002 Jacoby et al. ..... 102/307
6,371,219 B1 * 4/2002 Collins et al. ..... 102/311

* cited by examiner

*Primary Examiner*—Peter A. Nelson

(57) ABSTRACT

Shaped charge liners, typically used in perforating guns, are formed from a zinc alloy of zinc and other metals such as aluminium and magnesium. The liners are formed into desired shapes, for example, by melting ingots and casting the alloy, or by machining bars formed from the alloy, or by stamping strips formed from the alloy, or by pressing powder formed from the alloy.

50 Claims, 8 Drawing Sheets

SHAPED CHARGE LINER AND PROCESS

FIELD OF INVENTION

This invention relates generally to liners for shaped charges and more particularly to liners for shaped charges of the type used in perforating gun systems.

BACKGROUND OF THE INVENTION

Development of an oil or gas well often involves fixing a tubular steel casing in cement in an underground well borehole. Holes, or perforations, are subsequently created in the steel well casing and surrounding cement in order to gain access to the surrounding formation, e.g., an oil or gas bearing stratum. Such holes are generally created through a process known also as perforation using a perforating gun.

Perforation is a process of piercing the well casing, the surrounding cement, and rocks in the surrounding formation to provide fluid communication between the oil or gas deposit and the interior of the well. Explosive charges are typically used to pierce the well casing. Perforation involves introducing a firing device, commonly termed a perforating gun, into the well, positioning the perforating gun at a desired depth, and detonating the gun. The process of locating a perforation gun in position is sometimes referred to as "delivering" the gun. After detonation, the gun may be retracted or released and dropped to the bottom of the well. If discarded, the size of the gun is limited by the depth of the bottom hole available.

Several perforating methods have been used to deliver and detonate a perforating gun. For example, the "wireline" process involves attaching a perforating gun, or string of guns, to a long, flexible steel cable paid out from a truck-mounted drum at the surface. An electrical conductor, paid out with the cable and connected to the gun, or the gun in the string nearest to the surface, carries an electrical signal to energize the perforating gun detonator. Alternatively, tube conveyed perforating (TCP) employs straight production tubing to carry or convey the perforating gun to a desired position in the well. The gun may be activated by a drop bar. The gun may also be activated by hydraulic means. For example, fluid in the tubing may be pressurized sufficiently to activate a hammer and firing pin of a percussion detonator on the gun.

An explosive charge is typically contained in a charge assembly that may include a casing and a metal liner. The casing may typically have a recess having an inner wall structure and an opening. The explosive charge is packed against the inner wall of the charge casing. The metal liner may line the explosive charge opposite the casting. As such the explosive charge is contained between the liner and the casing. The shape of the explosive charge is defined by the space between the inner wall of the casing and the metal liner and is thus referred to as a "shaped charge". This space often has a concave, typically generally conical, shape. The term "shaped charge" may also refer to a charge assembly. The shape of such a charge may be varied, depending on the pattern of perforations desired, the size and number of perforations desired, and the depth of the perforations in the surrounding mineral bearing stratum.

A perforating gun may typically include an elongate member in the nature of a hollow tube having openings, or seats, into which the shaped changes are mounted. Several charge assemblies are generally arranged along the length of the elongate member. Typically, a detonation cord runs along the perforation gun between, and is connected to, the charges. Typically, the shaped changes are mounted such that the wide part of the conical shape faces radially outwardly, i.e., away from the gun, and toward the wall of the well bore, generally having a central axis aimed in a plane transverse to the length of the elongate member. Different explosive charges may face radially outwardly in different angular directions in the plane or in spaced, parallel planes to produce a helical perforation pattern.

When detonated, each shaped charge produces a compressive shock wave. This may collapse the liner and propel the central portion of the liner at a very high speed, possibly of the order of about 10,000 m/sec, thereby forming an explosive central jet. This jet pierces the well casing and the surrounding cement, and penetrates some distance into the oil bearing formation. The differently facing charges explode radially outwardly in different angular directions into the oil-bearing formation. The result is a perforated wall, like a colander, that facilitates entry of oil or gas into the well.

The outer, slower moving portion of the liner may have a tendency to form a slug, sometimes called a "carrot" due to its shape. The slug can cause numerous problems. The slug may embed itself in the exit hole of the perforating gun and cause mechanical difficulties in removing the perforating gun from the well borehole. The slug, when embedded in the perforation pierced by the explosive jet, may tend to impede the outflow of oil or gas, thus reducing the performance of the well. Sometimes, the slug may be carried by the gas or oil flow to the surface and cause malfunction of surface devices. The slug may also fall from the perforation gun down the well borehole into other downhole devices, possibly causing these devices to malfunction.

These problems caused by slugs have long been recognized. Efforts continue to be made to minimize or eliminate the formation of slugs. For example, U.S. Pat. No. 5,098,487, issued to Brauer et al. on Mar. 24, 1992 ("Brauer"), gives an account of various solutions directed at minimizing slug formation.

The majority (perhaps up to 90%) of liners used in the field are constructed of compacted metal powders. Metal powder liners tend to pulverize upon striking the well casing, and thus do not tend to cause undue formation of slugs. However, this type of liner may tend to have other disadvantages. They tend to be used in a green (i.e., unsintered) state, and as such may tend also to be relatively fragile. Care must be taken in their handling and assembly. Sintering, such as the process disclosed in U.S. Pat. No. 6,012,392, issued to Norman et al. on Jan. 11, 2000 ("Norman") may reduce this fragility, but is sometimes considered an unnecessary manufacturing step, particularly when it is often desirable for the device to fragment upon detonation.

Compacted metal powder liners in the green state also tend to be porous. There may be water at a depth in the well at which the shaped charge is to perforate holes in the well casing. Water may leak more easily through a porous liner and dampen the explosive charge lined by such a liner. This may cause detonation difficulties.

Often, liners made of compacted metal powders tend to be formed individually. Compared with liners formed in batches, individually formed liners may tend to have increased cost, and their product quality may tend to be less consistent and reliable. Additionally, because liners made of unsintered metal powders often pulverize upon striking the well casing, they may tend to be less effective for perforating large holes.

"Large holes" in this context may be holes of diameter up to about 1 inch. "Large holes" are often required for wells of heavy oil. Heavy oil, having higher viscosity, may tend to flow more easily from the surrounding oil bearing formation through these large holes and into the well. To obtain good production performance from such a heavy oil well, deep penetration with a depth of up to 30 inches may often be desired as well. Solid liners made of relatively heavy material may tend to be more effective for producing holes satisfying those requirements. This type of liner typically accounts for most, if not all, of the remaining 10% of liners in use. However, this type of liner has the tendency of forming relatively large slugs.

Zinc and zinc alloys have been used as a material for the outer casings of shaped charges. A casing made of zinc or a zinc alloy may tend to disintegrate without forming significant debris upon explosion of the explosive charge contained inside such a casing. The long held belief has been that some other material is required for the liner. Efforts have been made in searching for a better liner material. This may involve the development of special alloy mixes of copper.

For example, Brauer (quoted above) discloses a specially chosen copper alloy for making metal liners. The alloy, when heated to a temperature in the liner following detonation, is said to have a ductile matrix with a molten second phase dispersed within the matrix. Brauer states that the molten second phase reduces the tensile strength of the matrix so that the liner slug pulverizes on striking a well casing.

It has been observed by the present inventor that it would be advantageous to employ a liner that is made of a material of which the largest component is zinc. Advantageously, the liner may be made from the same material for making the casing. This material does not tend to require special alloy combinations, tends to be readily available, and tends to be relatively inexpensive. It tends not to require careful mixing of special expensive or exotic copper alloys. A number of methods are suitable for manufacturing zinc-based casings and liners. The present invention is part of the continuing efforts directed at overcoming the foregoing and other attendant difficulties. The liner disclosed herein may tend to be particularly useful in situations where it is required to perforate large holes, with reduced tendency to form slugs, although its application is not limited to such.

SUMMARY OF THE INVENTION

In an aspect of the invention there is a shaped charge comprising a casing, a liner, and an explosive charge. The casing has an apex at which to connect a detonation source, a mouth, and a divergent wall structure extending between the apex and the mouth. The divergent wall structure is narrower at the apex of the casing than at the mouth. The liner has a central region and a divergent skirt extending from the central region. The central region lies closer to the apex than to the mouth, and the skirt is mounted to the divergent wall structure closer to the mouth than to the apex. A charge cavity is defined between the casing and the liner. The explosive charge is contained within the charge cavity. The liner is formed from a metal material whose greatest component, by weight, is zinc.

In an additional feature of that aspect of the invention, the metal material of the liner is predominantly zinc. In another additional feature, the metal material of the liner is more than 70% zinc by weight. In yet another additional feature, the metal material of the liner is more than 90% zinc by weight.

In still another additional feature, the metal material of the liner is made of a metal material that is essentially zinc. In a further additional feature, the liner is made from zinc, aluminium and magnesium. In yet a further additional feature, the liner and the casing are made of the same material. In still a further additional feature, the casing is formed from a metal material whose greatest component, by weight, is zinc. In another additional feature, the liner and the casing are made of a metal material that is at least 50% zinc by weight.

In yet another additional feature, the shaped charge has an axis of symmetry, and the casing has the form of a body of revolution relative to the axis of symmetry. In still another additional feature, the charge cavity has a first region lying on the axis of symmetry, and a second region lying radially away from the axis of symmetry. The second region has a diminished thickness relative to the first region. In still yet another additional feature, the liner has a conic region lying at a conic angle relative to the axis. In a further additional feature, the conic angle is in the range of 15 to 40 degrees. In yet a further additional feature, the liner is of constant thickness. In still a further additional feature, the central region of the liner forms a bottom region of a valley and the divergent skirt forms sloped sides of the valley such that the liner is generally V-shaped. In another additional feature, the liner is a casting.

In another aspect of the invention there is a method of manufacturing a shaped charge. The method comprises the steps of providing a casing having an apex at which to connect a detonation source, a mouth, and a divergent wall structure extending between the apex and the mouth. The divergent wall structure is narrower at the apex of the casing than at the mouth, forming a liner from a metal material whose greatest component, by weight, is zinc. The liner has a central region and a divergent skirt extending from the central region, providing an explosive charge and locating the explosive charge in the casing, locating the liner in position relative to the casing to form a charge cavity containing the explosive charge. The step of locating the liner in position includes the step of locating the central region of the liner closer to the apex of the casing than to the mouth and locating the skirt adjacent to the divergent wall structure closer to the mouth than to the apex.

In an additional feature of that aspect of the invention, the step of forming the liner includes the step of providing a material whose greatest component, by weight, is zinc. In another additional feature, the step of forming the liner includes the step of providing a liner material that is predominantly zinc. In yet another additional feature, the step of forming the liner includes the step of providing a liner material that is more than 70% zinc by weight. In still another additional feature, the step of forming the liner includes the step of providing a liner material that is more than 90% zinc by weight. In still yet another additional feature, the step of forming the liner includes the step of providing liner material that is essentially zinc.

In a further additional feature, the step of forming the liner includes the step of making the liner and the casing of the same material. In yet a further additional feature, the step of forming the liner includes the step of making both the liner and the casing of materials that are at least 50% zinc by weight. In still a further additional feature, the step of forming the liner from a powder metal. In another additional feature, the step of locating the liner includes the step of pressing the powder metal liner in a green state against the explosive charge. In yet another additional feature, the step of forming the liner includes sintering the powder metal.

In still another additional feature, the step of forming the liner includes the step of using a metal material of constant thickness. In a further additional feature, the step of forming the liner includes casting the liner. In yet a further additional feature, the step of forming the liner includes machining the liner.

In another aspect of the invention there is a kit for assembling into a shaped charge for receiving and retaining an explosive charge for use with perforating guns, comprising a casing and a liner. The casing has an apex at which to connect a detonation source, a mouth, and a divergent wall structure extending between the apex and the mouth. The divergent wall structure is narrower at the apex of the casing than at the mouth. The liner has a central region and a divergent skirt extending from the central region. The skirt is mountable to the divergent wall structure to form a charge cavity between the liner and the casing for containing the explosive charge. The liner is mountable to the casing, and the skirt is closer to the mouth than to the apex and the central region lies closer to the apex than to the mouth upon mounting the skirt to the divergent wall. The liner is formed from a metal material whose greatest component, by weight, is zinc.

In an additional feature of that aspect of the invention, the metal material of the liner is predominantly zinc. In another additional feature, the metal material of the liner is more than 70% zinc by weight. In yet another additional feature, the metal material of the liner is more than 90% zinc by weight. In still another additional feature, the metal material of the liner is essentially zinc. In still yet another additional feature, the casing is formed from a metal material whose greatest component, by weight, is zinc. In a further additional feature, the liner and the casing are made of the same material. In yet a further additional feature, the liner is a casting.

In another aspect of the invention there is a rail method of manufacturing a shaped charge liner for use with a casing for containing an explosive charge. The casing has an apex at which to connect a detonation source, a mouth, and a divergent wall structure extending between the apex and the mouth. The divergent wall structure is narrower at the apex of the casing than at the mouth, comprising the steps of forming a liner. The liner has a central region and a divergent skirt extending from the central region. The skirt is mountable to the divergent wall structure to form a charge cavity between the liner and the casing for containing the explosive charge. The skirt is closer to the mouth than to the apex and the central region lies closer to the apex than to the mouth upon mounting the skirt to the divergent wall. The liner is formed from a metal material whose greatest component, by weight, is zinc.

BRIEF DESCRIPTION OF THE DRAWINGS

For a better understanding of the present invention and to show more clearly how it may be carried into effect, reference will now be made by way of example, and not of limitation, to the accompanying drawings, which show an apparatus according to the principles of the present invention and in which.

DETAILED DESCRIPTION OF THE PREFERRED EMBODIMENT

Figure 1B:
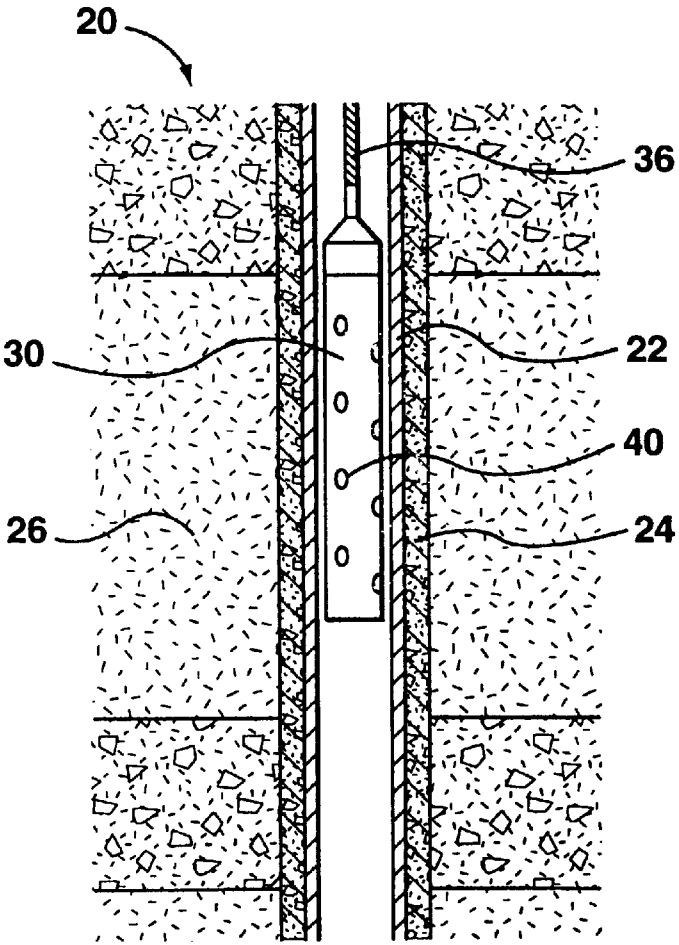
FIG. 1*b* shows an alternative method of delivering a perforating gun of FIG. 1*a*, i.e., suspending the perforating gun in an oil well by a wireline.

The description which follows, and the embodiments described therein, are provided by way of illustration of an example, or examples of particular embodiments of the principles of the present invention. These examples are provided for the purposes of explanation, and not of limitation, of those principles and of the invention. In the description that follows, like parts are marked throughout the specification and the drawings with the same respective reference numerals. The drawings are not necessarily to scale and in some instances proportions may have been exaggerated in order more clearly to depict certain features of the invention.

Figure 1A:
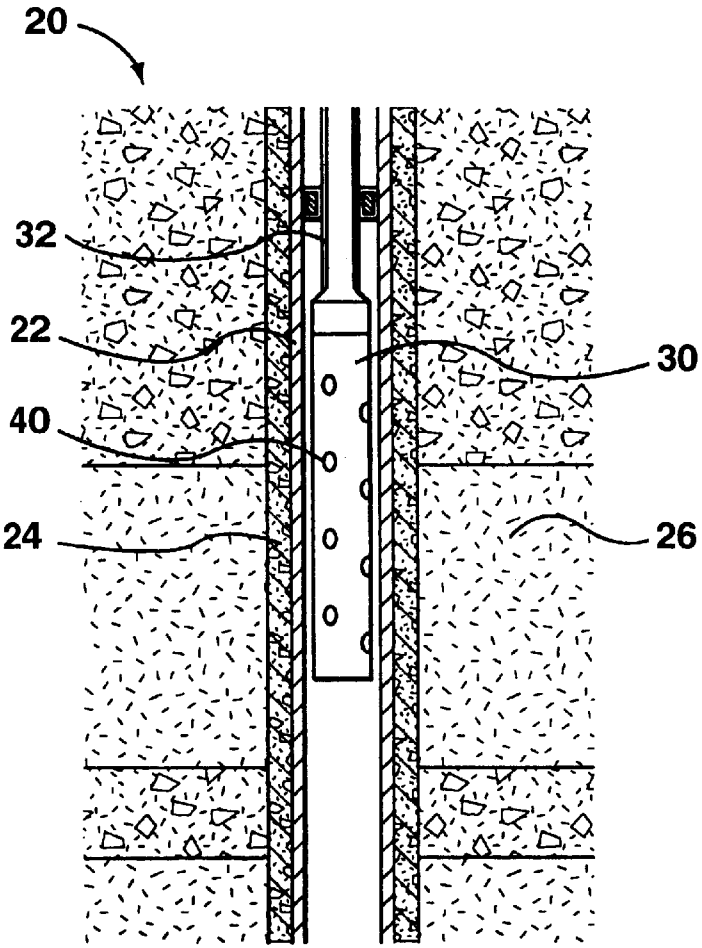
FIG. 1*a* shows a perforating gun suspended in an oil well by a production tubing.

By way of a general overview, an oil or gas well is indicated generally in FIG. 1*a* as 20. Well 20 has a well casing 22 surrounded by cement 24. Cement 24 is cast in the bore to fill the generally annular space between casing 22 and oil- or gas-bearing formation 26. Well 20 may extend to a depth of several kilometers from the surface, i.e., ground level. A perforating gun 30 is suspended in well 20 by production tubing 32 and is delivered at a desired depth. At such a depth, perforations produced in well casing 22, surrounding cement 24, and surrounding oil-bearing formation 26 may tend to allow oil to flow from oil-bearing formation 26 into well 20. Shaped charges 40 are arranged along the length of gun 30, as indicated schematically in FIG. 1*a*. FIG. 1*b* shows an alternative delivery method, where gun 30 is suspended and delivered at a desired depth by wireline 36.

For the purposes of this description, the bore of well 20, and the perforating gun for location in the well, can be considered in a polar co-ordinate system in which the axial direction of the bore (i.e., the direction in which well bore is drilled) is a first, or longitudinal axis. In such a frame of reference the radial direction extends perpendicularly outward from the axial direction. A third, circumferential angular co-ordinate establishes the angular orientation, relative to some specified datum angle, along a radius lying in a plane perpendicular to the axial direction. Although the well bore may be drilled at an angle, or vertically, or horizontally, for the purposes of this description, in the context of a well bore, upward means toward the well head, and downward means away from the well head, whatever the local orientation of the well bore may be. Local reference to "upward" and "downward" is then the direction parallel to the longitudinal axis, i.e., the axial direction. Similarly, radial means the direction toward or away from the longitudinal axis.

Figure 2:
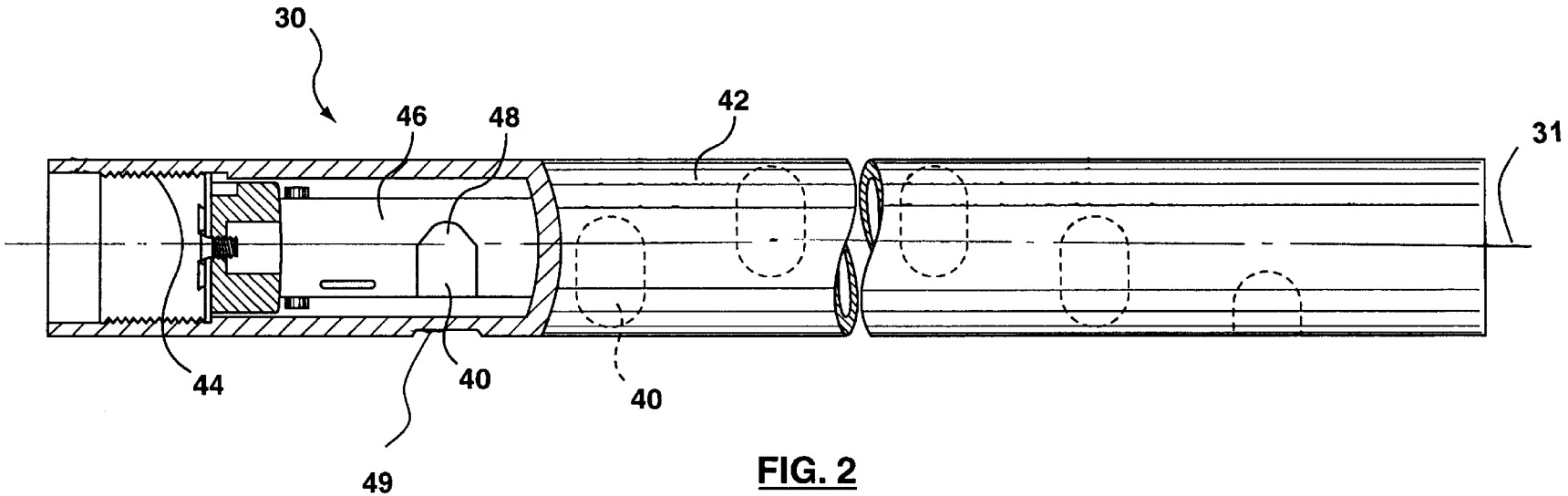
FIG. 2 is a partially sectional view of the perforating gun of FIG. 1*a;*

FIG. 2 shows perforating gun 30 having an elongate member in the nature of outer housing 42. Outer housing 42 has the general shape of a hollow circular tube, or cylinder. A threaded connection 44 is formed on the inner wall of the tube toward one end of housing 42 for mounting gun 30 to production tubing 32. A charge holder 46 is mounted inside outer housing 42. Charge holder 46 has a number of longitudinally spaced recesses 48 in which to mount shaped charges 40. Recesses 48 are generally formed radially into charge holder 46, with one side being open. The wall thickness of housing 42 is locally reduced as at 49 opposite each recess 48 to facilitate perforation upon detonation, yet to tend to keep water out of gun 30 during delivery.

A set of shaped charges 40 form an array mounted along charge holder 46, as indicated by dotted lines in FIG. 2. Most typically the charges are arrayed in a spiral, or helical fashion, in that each charge is turned relative to its neighbours on an angular pitch, while the charges are separated along the gun at a longitudinal pitch. The combination of angular and longitudinal incremental pitches may tend to result in a helical discharge pattern. FIG. 2 illustrates 6 shaped charges 40 mounted on charge holder 46. A different charge holder that can hold a different number of shaped charges may also be used, depending on the desired density of perforation at a given depth of the oil or gas well.

Figure 3A:
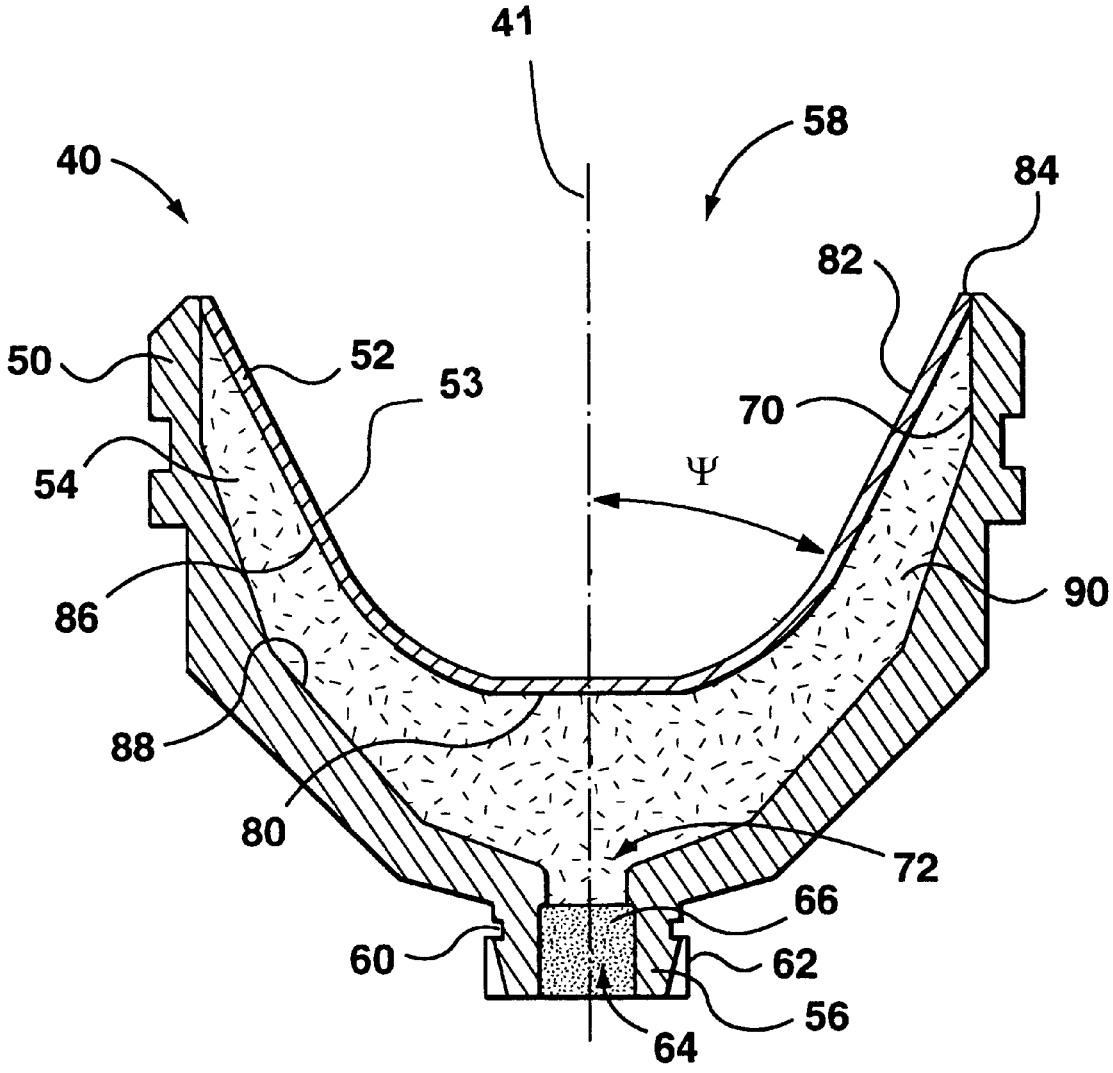
FIG. 3*a* shows, in cross-sectional view, a shaped charge of the perforating gun of FIG. 2.
Figure 3B:
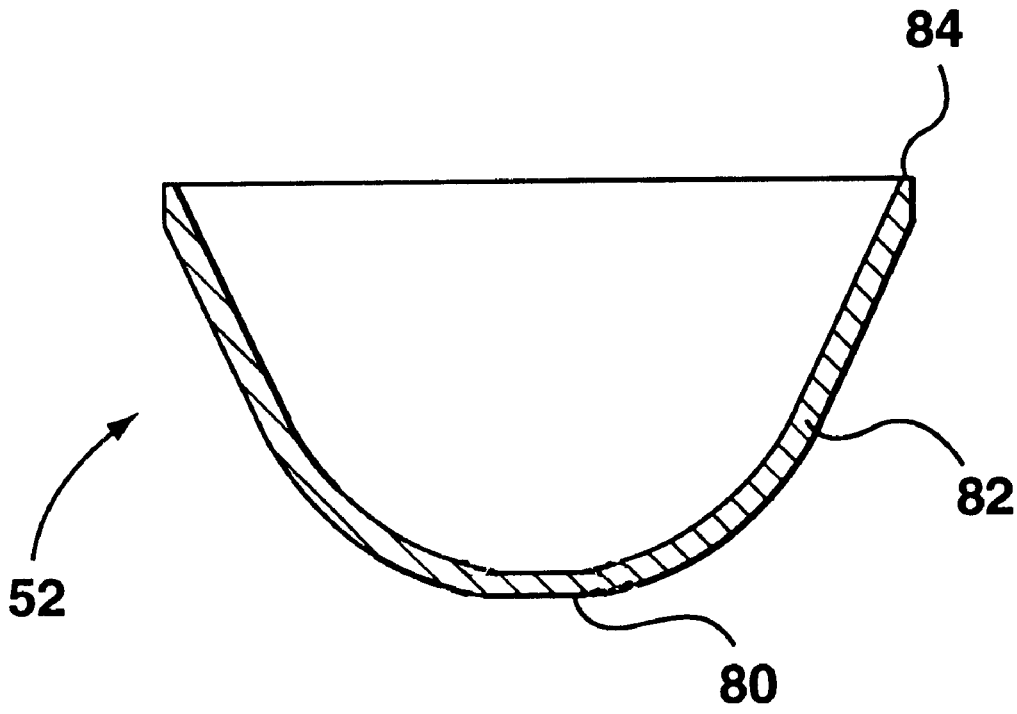
FIG. 3*b* shows a detail view of a liner for the shaped charge of FIG. 3*a;*
Figure 3C:
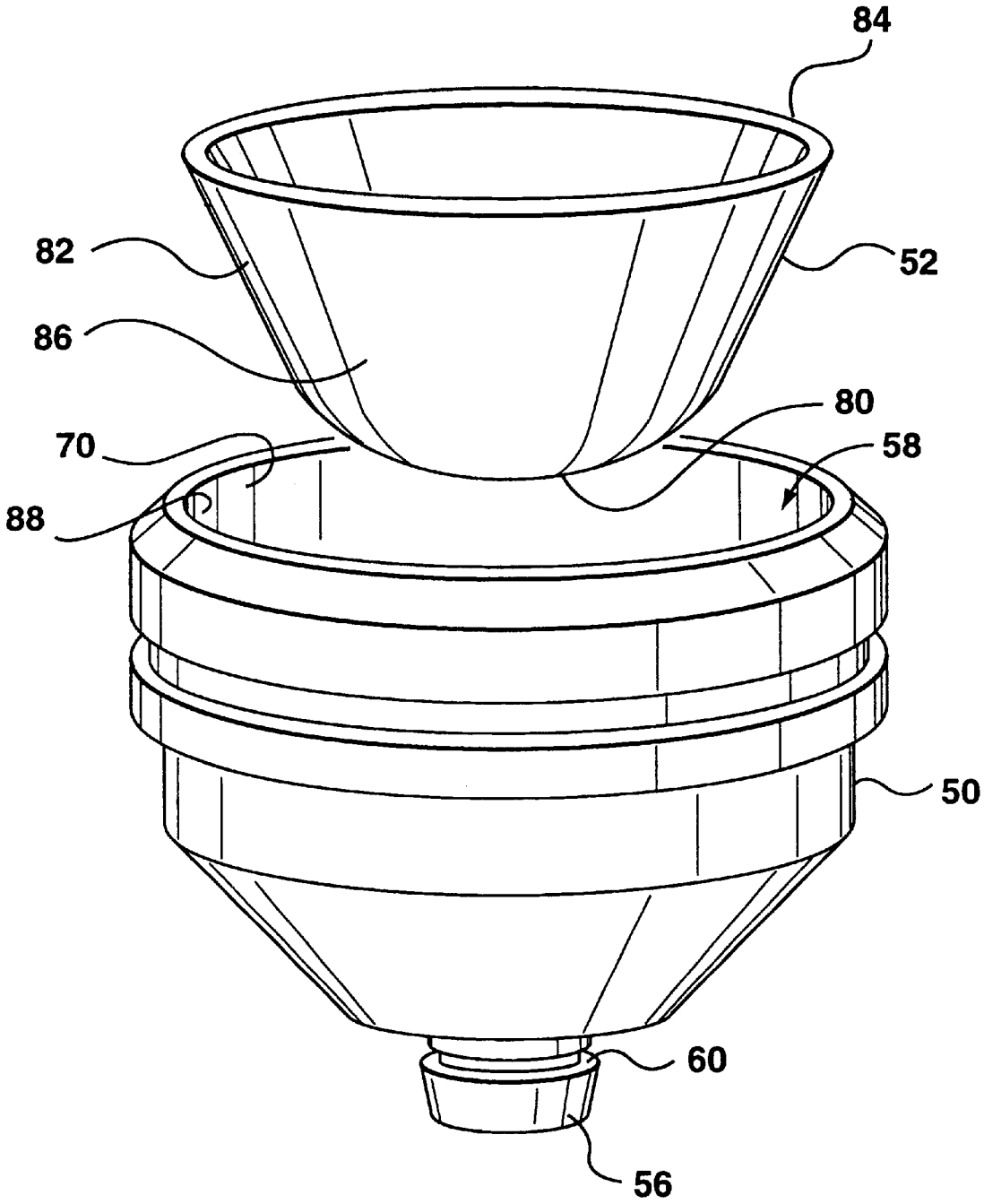
FIG. 3*c* shows an isometric exploded view of the shaped charge of FIG. 3*a;*
Figure 3D:
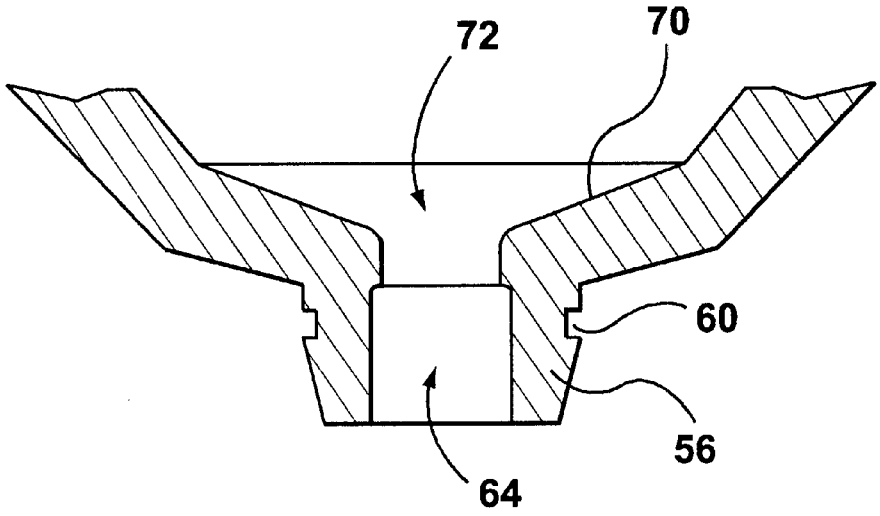
FIG. 3*d* shows a detail view of a casing for the shaped charge of FIG. 3*a;*

FIG. 3*a* shows a shaped charge 40 in a cross-sectional view. Shaped charge 40 has a casing 50, a liner 52, and an explosive charge 54. Liner 52 cooperates with casing 50 to hold explosive charge 54 in casing 50 between casing 50 and liner 52. In this specification, the term "shaped charge" hereinafter refers to an assembly of a casing, a liner and an explosive charge, such as the one illustrated, for example, in FIG. 3*a*. Casing 50 has a leg 56. When shaped charge 40 is mounted in recess 48, leg 56 is proximate to the longitudinal axis of charge holder 46 and is located in the interior of recess 48.

A second frame of reference can be defined for the purposes of this description in terms of the geometry of the shaped charge. Where a shaped charge is formed as a body of revolution, the axis of the resultant jet of the shaped charge can be defined as the primary, or central axis of the charge. Typically, the shaped charge is installed in a detonator at an orientation such that the central axis of the charge is perpendicular to the longitudinal axis of the perforating gun, such that the jet of the shaped charge, when fired, will discharge radially (relative to the longitudinal axis of the well bore) into the well liner and casing, and into the surrounding mineral bearing stratum. The shaped charge is usually installed such that a second axis can be defined parallel to the longitudinal axis of the perforating gun, and a third axis can be defined lying in a plane (typically a horizontal plane) perpendicular to the longitudinal axis of the perforating gun. The proximal end of the shaped charge is located near the longitudinal axis 31 of gun 30, and the distal end of the shaped charge is located remote from the longitudinal axis 31 of gun 30.

Casing 50 as illustrated in FIG. 3*a* is a body of revolution, the axis of rotation, or axis of symmetry, being the central axis 41 of shaped charge 40. Casing 50 has a divergent or bowl-like wall structure, in the nature of interior wall 70, a recess formed along the central axis 41, and a mouth, or opening 58. Interior wall 70 has an apex 72 located toward leg 56. Opposite apex 72 is opening 58. In general, interior wall 70 widens gradually from apex 72 toward opening 58. Interior wall 70 shown in FIG. 3*a* is made up of a series of truncated conical sections catenated together, each conical section having its smaller end lying closer to leg 56 and its larger end lying closer to opening 58.

Leg 56 protrudes along the central axis, and, on assembly seats at the inner end of recess 48 of charge holder 46. A circular groove 60 is formed on leg 56. A fastener in the nature of clip 62, is received in groove 60 and co-operates with recess 48, to secure leg 56, and thereby shaped charge 40, inside recess 48. In this position, opening 58 is remote from longitudinal axis 31 of change holder 46 and generally faces radially outwardly away from longitudinal axis 31. Leg 56 also has an aperture 64 in the nature of a through hole formed along the central axis. Initiator material 66 fills aperture 64. A detonation cord (not illustrated) runs into aperture 64 for detonating initiator material 66.

Liner 52 shown in FIG. 3*a* is also a body of revolution and also has a divergent or bowl-like wall structure 53. Liner 52 has a first portion shown as a generally round, central region in the nature of bowl end 80. A second portion of liner 52 namely skirt, or sidewall 82, extends smoothly away from bowl end 80, gradually widens as it extends along the central axis, and terminates at distal lip or brim 84. The shape of sidewall 82 is generally that of the sidewall of a truncated cone. The truncated cone has a conical angle, $\psi$ as measured between axis 41 and tangent portion 82.

In a preferred embodiment, liner 52 has a substantially uniform thickness of about 0.064 inches. The conical angle $\psi$ is about 26°. The truncated cone has a large end brim 84 of about 1.8 inches in diameter, matching the size of opening 58, and a height of about 0.5 inches. Bowl end 80 is approximately a portion of a sphere of about 0.7 inches in diameter and joins smoothly with sidewall 82 at the small end of the truncated cone.

FIG.3*a* shows casing 50 and liner 52 in an assembled configuration. In this configuration, the central axes of casing 50 and liner 52 tend to coincide with each other. Bowl end 80, i.e., the central region of liner 52, lies closer to apex 72 than to opening 58. The skirt, or sidewall 82, is mounted to casing 50 at a location near opening 58. Distal brim 84 encircles an area that is comparable to opening 58 in size. In the assembled position, liner 52 tends to block opening 58, thereby containing, and retaining, charge 54.

As described above, liner 52 has a first profile 86 defined by the inner faces of sidewall 82 and bowl end 80. Casing 50 has a second profile 88 defined by interior wall 70. When liner 52 is mounted to casing 50, the first and second profiles cooperate to define an enclosed space in the nature of charge cavity 90 therebetween. Explosive charge 54 is packed against interior wall 70 and liner 52. As such, explosive charge 54 is retained in charge cavity 90 and may acquire a shape defined by charge cavity 90. Aperture 64 provides a path of communication between initiator material 66 and explosive charge 54 retained in charge cavity 90. Detonation of initiator material 66 tends to subsequently detonate explosive charge 54. As will be described below, the shape of explosive charge 54 may be varied by varying first profile 86 of liner 52 and second profile 88 of casing 50 so that different perforation results may be achieved.

In assembling shaped charge 40, an appropriate amount of explosive powder is added to casing 50. Leg 56 may be tapped to level the powder. A die, having a shape substantially conforming with first profile 86 of liner 52, may press down through opening 58 and compact the explosive charge powder against interior wall 70. Liner 52 may then be placed against the concave side of explosive charge 54 and mounted to opening 58. Any stray powder may then be cleaned away.

According to the present invention, liner 52 is formed from a metal material whose greatest component, by weight, is zinc. Notwithstanding previous assumptions to the contrary, the inventor has found that such a zinc-based liner may tend to be effective for perforating steel well casings. Using zinc or zinc alloy as a liner material may tend to have a number of advantages. Zinc is readily available and tends to be cheaper than some other liner materials such as special alloy mixes of copper. Unlike a lead-based liner, a zinc-based liner may tend to be more environmentally benign. Forming liners from sheets of a zinc alloy by stamping, or from bars of a zinc alloy by machining may tend to be relatively easy because of the relatively good formability and machinability of zinc alloys. The relatively low melting temperature of zinc or zinc alloys may also tend to permit direct casting of liners in relatively large quantities. Casting tends to be faster and more cost-effective than other production methods such as machining. Additionally, as casings are often made of a zinc alloy, liners may advantageously be made of the same material as is presently used for making casings. This may provide an additional advantage of reducing inventory costs.

It is advantageous to use an alloy that is predominantly zinc by weight, i.e., an alloy that contains more than 50% of zinc by weight. For example, the zinc alloy may have at least 70% of zinc by weight. Pure zinc, i.e. a metal having more than 99% of zinc by weight, may also be used. Or, the zinc alloy may have a proportion of zinc, by weight, lying in the range of about 70% to about 97% zinc. In particular, the zinc alloy may be formed from zinc, aluminium, and magnesium.

In a preferred embodiment, liners are formed from a zinc alloy containing about 95.96% zinc, about 4% aluminium, and about 0.04% magnesium by weight. More particularly, the practice of the present invention may advantageously be accomplished utilizing an alloy available from Zincaloy Inc., 1565 Bonhill Road, Mississauga, Ontario, Canada, L5T 1M1 and sold under the trade name of ZAMAC #3. In a preferred embodiment, both casing 50 and liner 52 are made by casting from the zinc alloy identified as ZAMAC #3.

Other methods may be employed to form zinc-based casings and liners. For example, both casings and liners may be formed by machining a bar. However, because of the generally bowl-like shape, forming casings and liners by machining may tend to entail the discard of more raw material than may be desirable. Stamping or pressing a sheet of liner material upon a form that has a desirable surface shape for the liner may be another method of forming a liner. Cold pressing metal powders of the liner material may be yet another method of forming a liner. Although the density of a liner formed by cold pressing may potentially reach about 96% of the density of the powder material or higher, an unsintered liner, i.e., a liner in a green state, may lack a great strength against any crushing force. Sintering may tend to encourage coherence of cold pressed powders and thus may tend to increase the strength of the liner.

In a preferred embodiment, the explosive powder is RDX, a commercially available explosive sold by, for example, Goex International, 423 Vaughn Road West, Cleburne, Tex. 76031. Any other suitable explosive may be used. Some examples include CH-6, HMX, PETN, HNS, PYX, all of which are trade names of commercially available explosive products.

Liner shapes may affect the perforation results. For example, liner 52 illustrated in FIG. 3*a* is more bowl-like than conical given the relative proportions of bowl end 80, conical wall portion 82 and distal brim 84. Such a liner may tend to be advantageous in perforating large holes of a penetration depth of as deep as 10 inches. Large holes of such a penetration depth have the tendency of providing good communication between the bore of the well and the adjacent formation containing heavy oils. A more sharply conical, less bowl-like shape may yield different penetration characteristics.

Figure 4:
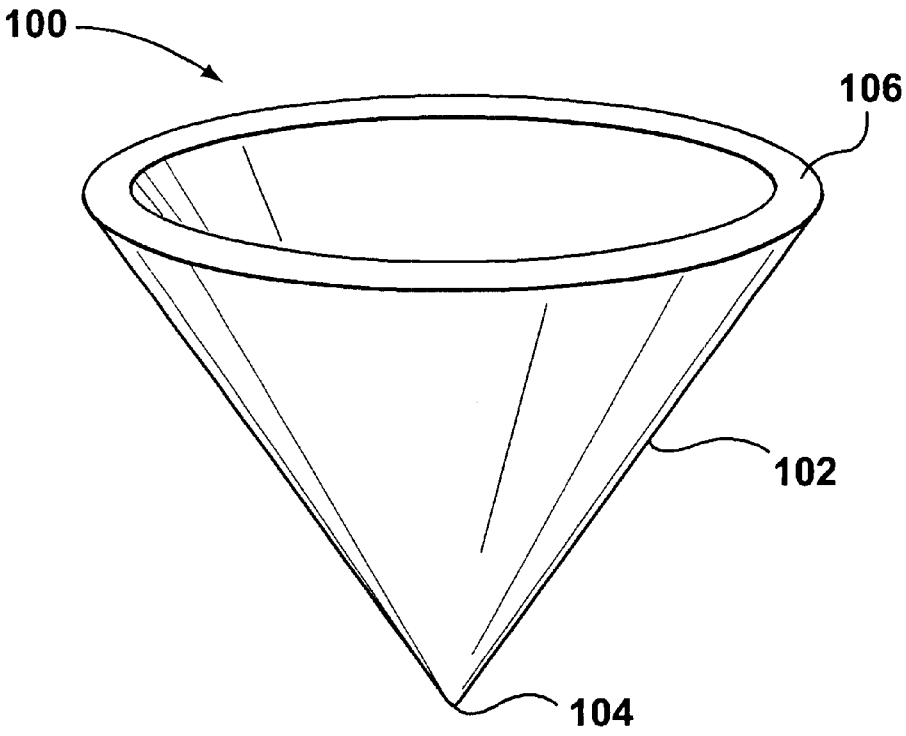
FIG. 4 shows a shaped charge liner of a substantially conical shape, as an alternative to a liner of bowl-like shape as shown in FIG. 3*c;*

FIG. 4 illustrates an alternative embodiment of a shaped charge liner. Liner 100 has a relatively sharply conical sidewall 102 joined to bowl end 104. Side wall 102 extends from bowl end 104 to brim 106. Bowl end 104 is significantly smaller in relative proportion to wall 102 and brim 106 than in the example of liner 52 of FIG. 3*a*. As such, liner 100 is substantially conical. Substantially conical liners may tend to produce more focused high-speed jet. Thus, these liners tend to produce smaller perforations, but deeper perforations perhaps as deep as 60 inches. Perforations like these may be more suitable for wells of gas or lighter oil. Shaped changes with intermediate properties can be produced using liners of proportions intermediate these of liners 52 and 100.

Shaped charges may take some other shapes. Descriptions of shaped charges of various other shapes and corresponding shaped charge liners may be found, for example, on pages 737–8 of *High Velocity Impact Dynamics* (Ed. Jonas A. Zukas, John Wiley & Sons, Inc., New York 1990).

Figure 5:
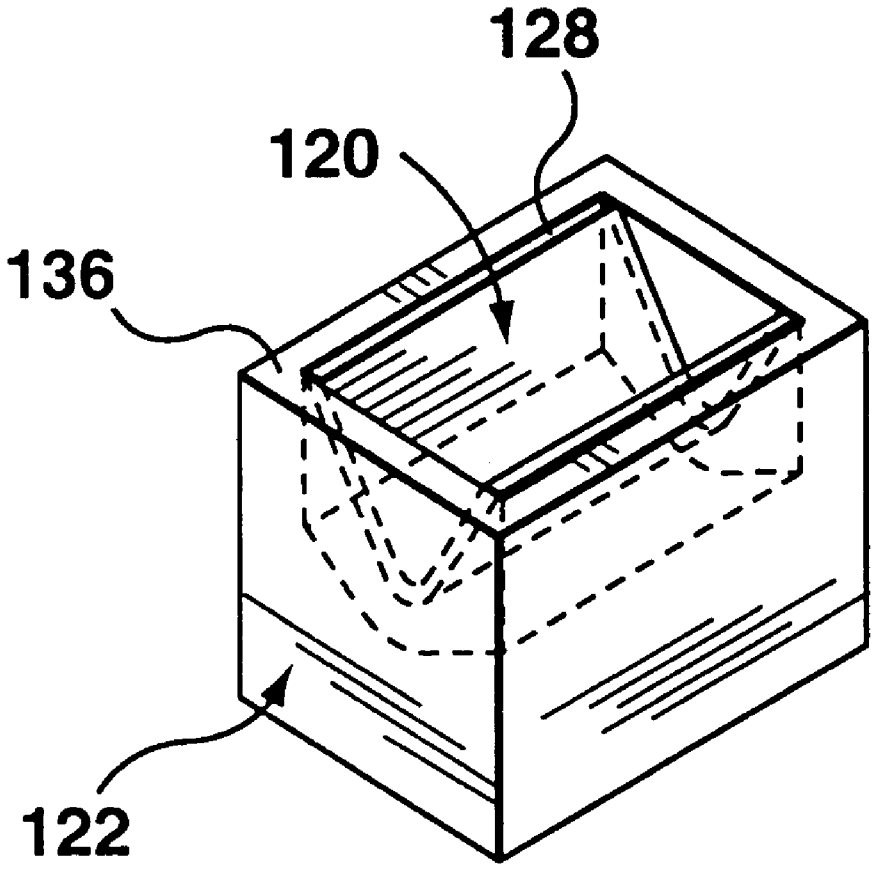
FIG. 5 shows a shaped charge liner having a cross-sectional "V" shape and a shaped charge casing for receiving the V-shaped charge liner, as an alternative to the casing and liner shown in FIG. 3*a;*
Figure 6:
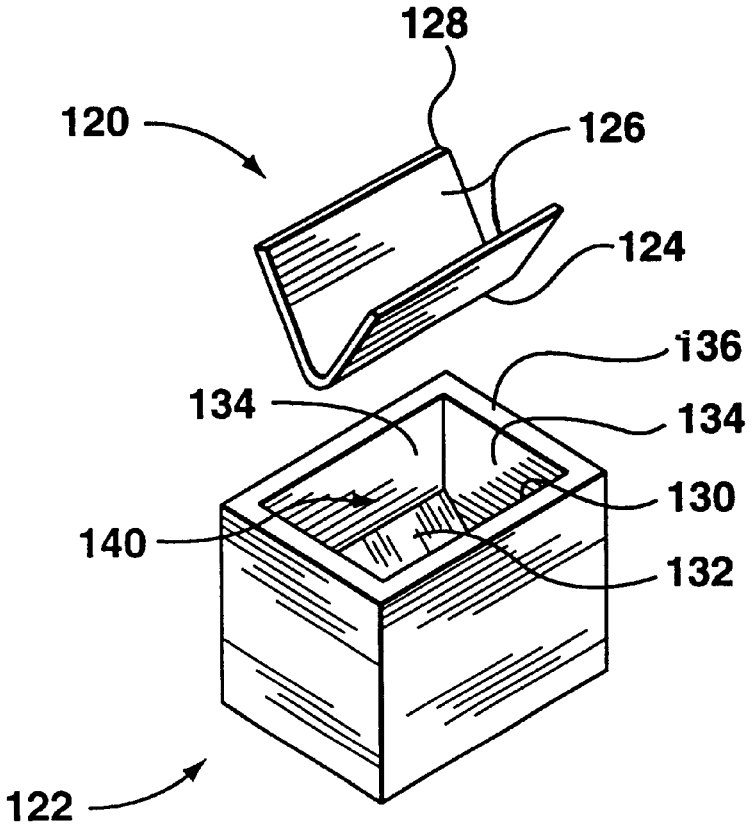
FIG. 6 shows a V-shaped rectangular shaped charge liner and casing of FIG. 5 in an exploded configuration.

FIG. 5 and FIG. 6 show yet another alternative embodiment. A generally linear liner 120 is mounted to a generally linear casing 122. In cross-section, liner 120 has the shape of a long "V" having an elongate valley portion 124 flanked by two generally flat sidewalls 126. Sidewalls 126 terminate at edges 128. Casing 122 has an interior wall structure 130 in the nature of interior walls, i.e., two sloped flat sides 132 and four side walls 134. Two generally sloped flat sides 132 intersect each other along a line lying toward the innermost end of casing 122 and form a cross-sectional "V". Four side walls 134, two of which enclose each side of the long V formed by sloped flat sides 132, and two of which intercept each of sloped flat sides 132, terminate at a rectangular lip, or brim 136. Brim 136, having a rectangular shape, defines opening 140 of casing 122. Liner 120 is mounted in casing 122, as indicated in FIG. 5, with its valley portion 124 lying closer to the interior of casing 122 and its sidewall edges 128 near casing brim 136. In the mounted position, liner 120 tends to block opening 140.

Figure 7:
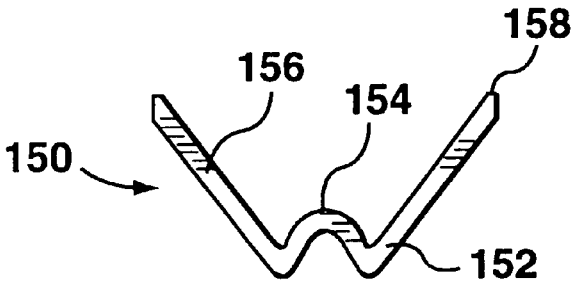
FIG. 7 shows another alternative shaped charge liner having a cross-sectional "W" shape as a further alternative to the liner of FIG. 3*a*.

FIG. 7 shows, in cross-sectional view, another generally linear liner 150 having a cross-sectional "W" shape. Liner 150 has a valley portion 152 having a slightly raised ridge 154. Divergent and flat sidewalls 156 of liner 150 extend from valley portion 152 and terminate at distal edges 158. Linear liners may tend to produce large holes of penetrations perhaps as deep as up to 30 inches.

Various embodiments of the invention have now been described in detail. Since changes in or additions to the above-described best mode may be made without departing from the nature, spirit or scope of the invention, the invention is not to be limited to those details, but only by the appended claims.

I claim:

1. A shaped charge comprising:

a casing, a liner, and an explosive charge;

said casing having an apex at which to connect a detonation source, a mouth, and a divergent wall structure extending between said apex and said mouth, said divergent wall structure being narrower at said apex of said casing than at said mouth;

said liner having a central region and a divergent skirt extending from said central region, said central region lying closer to said apex than to said mouth, and said skirt being mounted to said divergent wall structure closer to said mouth than to said apex;

a charge cavity defined between said casing and said liner;

said explosive charge being contained within said charge cavity; and said liner being formed from a metal material whose greatest component, by weight, is zinc; and said explosive charge being operable to cause a perforating jet to be formed from said metal material.

2. The shaped charge of claim 1 wherein said metal material of said liner is predominantly zinc.

3. The shaped charge of claim 1 wherein said metal material of said liner is more than 70% zinc by weight.

4. The shaped charge of claim 1 wherein said metal material of said liner is more than 90% zinc by weight.

5. The shaped charge of claim 1 wherein said metal material of said liner is made of a metal material that is essentially zinc.

6. The shaped charge of claim 1 wherein said liner is made from zinc, aluminium and magnesium.

7. The shaped charge of claim 1 wherein said liner and said casing are made of the same material.

8. The shaped charge of claim 1 wherein said casing is formed from a metal material whose greatest component, by weight, is zinc.

9. The shaped charge of claim 1 wherein both said liner and said casing are made of a metal material that is at least 50% zinc by weight.

10. The shaped charge of claim 1 wherein said shaped charge has an axis of symmetry, and said casing has the form of a body of revolution relative to the axis of symmetry.

11. The shaped charge of claim 10 wherein said charge cavity has a first region lying on said axis of symmetry, and a second region lying radially away from said axis of symmetry, said second region having a diminished thickness relative to said first region.

12. The shaped charge of claim 11 wherein said liner has a conic region lying at a conic angle relative to said axis.

13. The shaped charge of claim 12 wherein said conic angle is in the range of 15 to 40 degrees.

14. The shaped charge of claim 1 wherein said liner is of constant thickness.

15. The shaped charge of claim 1 wherein said central region of said liner forms a bottom region of a valley and said divergent skirt forms sloped sides of said valley such that said liner is generally V-shaped.

16. The shaped charge of claim 1 wherein said liner is a casting.

17. A process of manufacturing a shaped charge, said method comprising the steps of:

providing a casing having an apex at which to connect a detonation source, a mouth, and a divergent wall structure extending between said apex and said mouth, said divergent wall structure being narrower at said apex of said casing than at said mouth;

forming a liner from a metal material whose greatest component, by weight, is zinc, the liner having a central region and a divergent skirt extending from said central region;

providing an explosive charge for causing, in use, a perforating jet to be formed of a portion of said zinc containing metal material, and locating the explosive charge in the casing;

locating the liner in position relative to the casing to form a charge cavity containing the explosive charge; and said step of locating the liner in position including the step of locating said central region of the liner closer to said apex of said casing than to said mouth and locating the skirt adjacent to the divergent wall structure closer to said mouth than to the apex.

18. The method of claim 17 wherein said step of forming said liner includes the step of providing a material whose greatest component, by weight, is zinc.

19. The method of claim 17 wherein said step of forming said liner includes the step of providing a liner material that is predominantly zinc.

20. The method of claim 17 wherein said step of forming said liner includes the step of providing a liner material that is more than 70% zinc by weight.

21. The method of claim 17 wherein said step of forming said liner includes the step of providing a liner material that is more than 90% zinc by weight.

22. The method of claim 17 wherein said step of forming said liner includes the step of providing a liner material that is essentially zinc.

23. The method of claim 17 wherein said step of forming said liner includes the step of making said liner and said casing of the same material.

24. The method of claim 17 wherein said step of forming said liner includes the step of making both said liner and said casing of materials that are at least 50% zinc by weight.

25. The method of claim 17 wherein said step of forming said liner from a powder metal.

26. The method of claim 25 wherein said step of locating said liner includes the step of pressing said powder metal liner in a green state against said explosive charge.

27. The method of claim 25 wherein said step of forming said liner includes sintering said powder metal.

28. The method of claim 17 wherein said step of forming said liner includes the step of using a metal material of constant thickness.

29. The method of claim 17 wherein said step of forming said liner includes casting the liner.

30. The method of claim 17 wherein said step of forming said liner includes machining the liner.

31. A kit for assembling into a shaped charge for receiving and retaining an explosive charge for use with perforating guns, comprising:

a casing; and a liner for forming a perforating jet when the explosive charge is detonated;

said casing having an apex at which to connect a detonation source, a mouth, and a divergent wall structure extending between said apex and said mouth, said divergent wall structure being narrower at said apex of said casing than at said mouth;

said liner having a central region and a divergent skirt extending from said central region, said skirt being mountable to said divergent wall structure to form a charge cavity between said liner and said casing for containing the explosive charge;

said liner being mountable to said casing, and said skirt being closer to said mouth than to said apex and said central region lying closer to said apex than to said mouth upon mounting said skirt to said divergent wall structure; and said liner for forming a perforating jet being formed from a metal material whose greatest component, by weight, is zinc.

32. The kit of claim 31 wherein said metal material of said liner is predominantly zinc.

33. The kit of claim 31 wherein said metal material of said liner is more than 70% zinc by weight.

34. The kit of claim 31 wherein said metal material of said liner is more than 90% zinc by weight.

35. The kit of claim 31 wherein said metal material of said liner is essentially zinc.

36. The kit of claim 31 wherein said casing is formed from a metal material whose greatest component, by weight, is zinc.

37. The kit of claim 31 wherein said liner and said casing are made of the same material.

38. The kit of claim 31 wherein said liner is a casting.

39. A method of manufacturing a shaped charge liner for use with a casing for containing an explosive charge, the liner permitting a perforating jet to be formed therefrom upon detonation of the explosive charge, the casing having an apex at which to contact a detonation source, a mouth, and a divergent wall structure extending between said apex and the mouth, the divergent wall structure being narrower at said apex of said casing than at the mouth, said method comprising the steps of:

forming said liner to have a central region and a divergent skirt extending from the central region;

said skirt being mountable to the divergent wall structure to form a charge cavity between said liner and the casing for containing the explosive charge;

said skirt being closer to the mouth than to the apex, and said central region lying closer to the apex than to the mouth upon mounting of said skirt to the divergent wall structure; and said liner for forming the perforating jet being formed from a metal material whose greatest component, by weight, is zinc.

40. The method of claim 39 wherein said step of forming said liner includes the step of providing a liner material that is predominantly zinc.

41. The method of claim 39 wherein said step of forming said liner includes the step of providing a liner material that is more than 70% zinc by weight.

42. The method of claim 39 wherein said step of forming said liner includes the step of providing a liner material that is more than 90% zinc by weight.

43. The method of claim 39 wherein said step of forming said liner includes the step of providing a liner material that is essentially zinc.

44. The method of claim 39 wherein said step of forming said liner includes the step of forming said liner from a powder metal.

45. The method of claim 44 wherein said step of forming said liner includes sintering said powder metal.

46. The method of claim 39 wherein said step of forming said liner includes the step of using a metal material of constant thickness.

47. The method of claim 39 wherein said step of forming said liner includes the step of casting the liner.

48. The method of claim 39 wherein said step of forming said liner includes the step of machining the liner.

49. A shaped charge comprising:

a casing, a liner, and an explosive charge;

said casing having an apex at which to connect a detonation source, a mouth, and a divergent wall structure extending between said apex and said mouth, said divergent wall structure being narrower at said apex of said casing than at said mouth;

said liner having a central region and a divergent skirt extending from said central region, said central region lying closer to said apex than to said mouth, and said skirt being mounted to said divergent wall structure closer to said mouth than to said apex;

a charge cavity defined between said casing and said liner;

said explosive charge being contained within said charge cavity;

said liner being formed from a metal material whose greatest component, by weight, is zinc; and said metal material being at least 70% zinc by weight.

50. A shaped charge comprising:

a casing, a liner, and an explosive charge;

said casing having an apex at which to connect a detonation source, a mouth, and a divergent wall structure extending between said apex and said mouth, said divergent wall structure being narrower at said apex of said casing than at said mouth;

said liner having a central region and a divergent skirt extending from said central region, said central region lying closer to said apex than to said mouth, and said skirt being mounted to said divergent wall structure closer to said mouth than to said apex;

a charge cavity defined between said casing and said liner;

said explosive charge being contained within said charge cavity; and said liner being formed from a single material whose greatest component, by weight, is zinc.

* * * * *